United States Patent [19]

Anderson

[11] 4,341,391

[45] Jul. 27, 1982

[54] REPLACEABLE BLADE ARROWHEAD

[76] Inventor: Jeffrey J. Anderson, P.O. Box 11, Pottersville, N.J. 07979

[21] Appl. No.: 156,751

[22] Filed: Jun. 5, 1980

[51] Int. Cl.[3] ..... F41B 5/02

[52] U.S. Cl. ..... 273/422; 30/337

[58] Field of Search ..... 273/422, 421; D22/12; 30/337

[56] References Cited

U.S. PATENT DOCUMENTS

| | | | |
|---|---|---|---|
| D. 219,873 | 2/1971 | Ritchie | D22/12 |
| 2,909,372 | 10/1959 | Neri | 273/422 |
| 2,912,247 | 11/1959 | Doonan | 273/422 |
| 3,398,960 | 8/1968 | Carroll, Jr. | 273/422 |
| 3,756,600 | 9/1973 | Maleski | 273/422 |
| 4,006,901 | 2/1977 | Simo | 273/422 |
| 4,036,499 | 7/1977 | Sherwin | 273/422 |
| 4,146,226 | 3/1979 | Sorensen | 273/422 |
| 4,169,597 | 10/1979 | Maleski | 273/422 |
| 4,210,330 | 7/1980 | Kosbab | 273/422 |

OTHER PUBLICATIONS

Archery Magazine, 8–1974, p. 17, Robin Hood Archery, Inc., Chisel Point.

Archery Magazine, 2–1977, p. 6, Hunters International Ripper.

*Primary Examiner*—Paul E. Shapiro

*Attorney, Agent, or Firm*—Fisher, Christen & Sabol

[57] ABSTRACT

An arrowhead for hunting archers includes two or more interchangeable replaceable blades, each of which blades includes two axially spaced outwardly extending knife sections each of which has its leading edges sharpened to increase the depth of penetration of the arrowhead and trailing edges sharpened to facilitate angular penetration and withdrawal. The forward end of the arrowhead is blunt so as to cause it to be deflected away from a bone and to increase the slicing action of the knives. A knife may include dull notches to comb hair into the wound to prevent closure and the blades may be flexible enough to pass easily between adjacent ribs.

11 Claims, 10 Drawing Figures

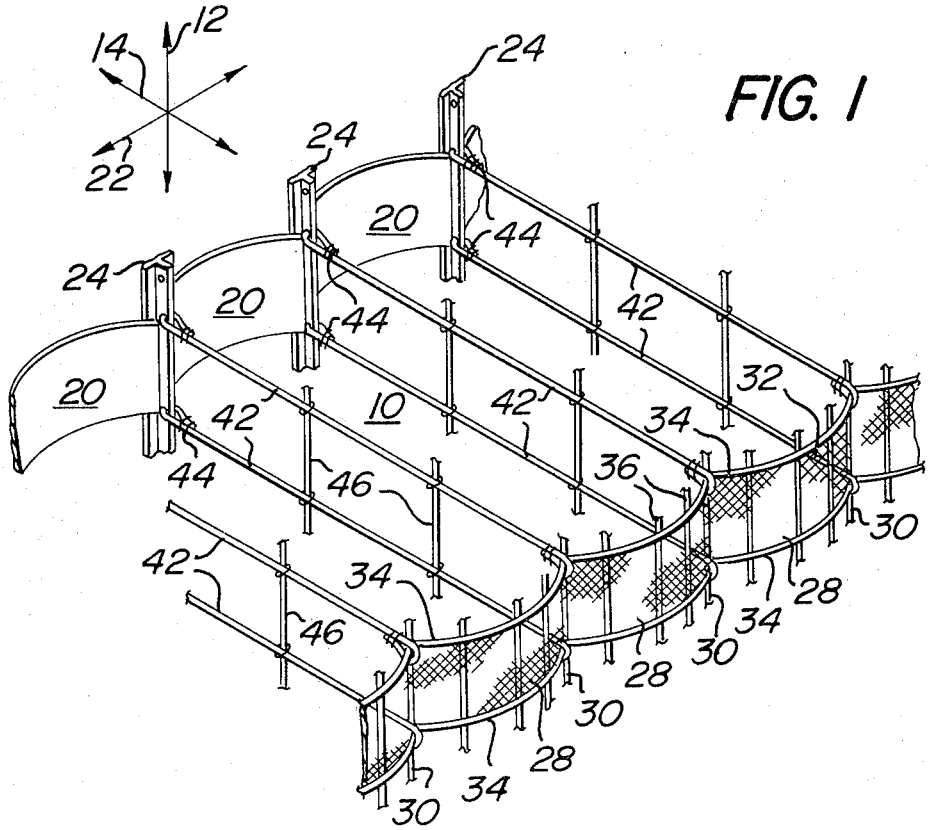
FIG. 1
FIG. 2
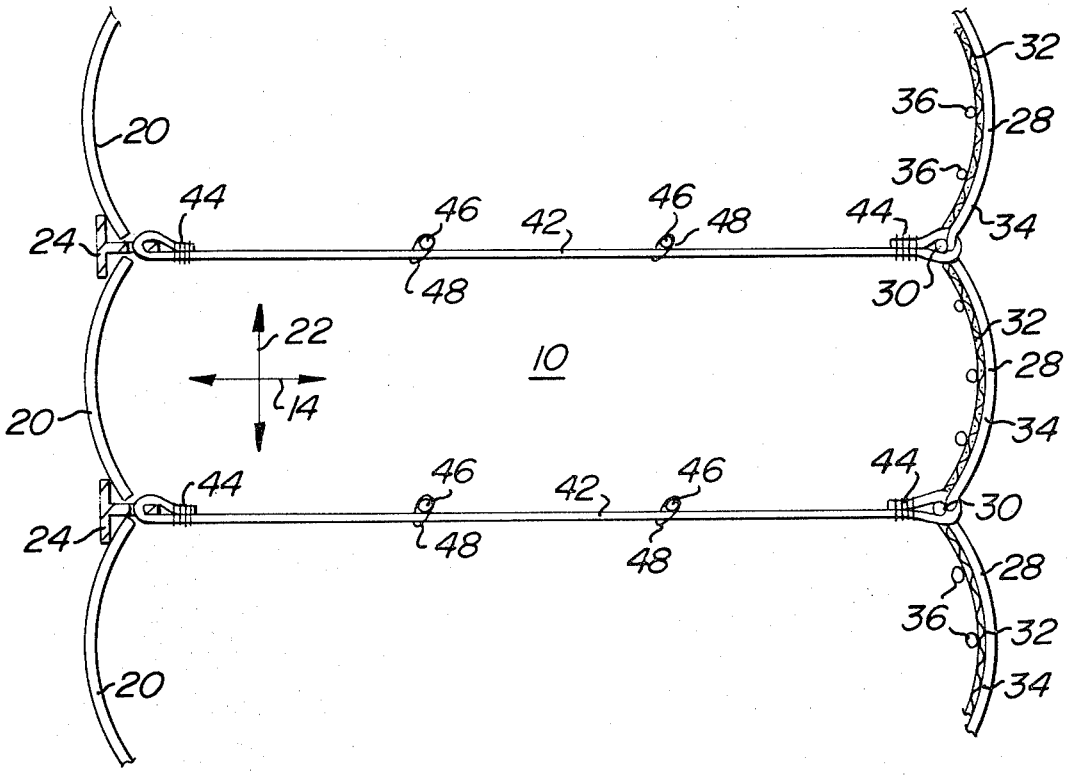

FIG. 3
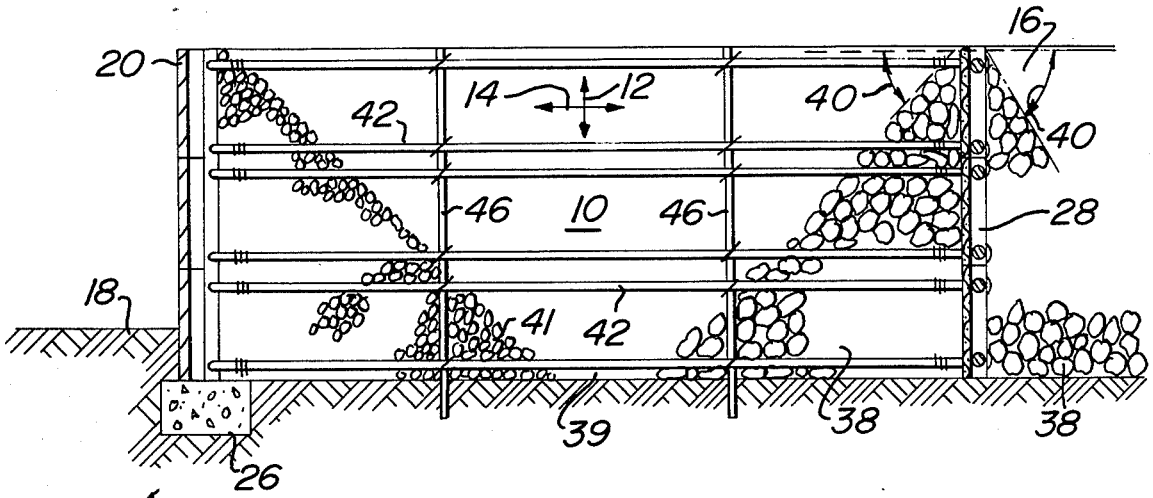
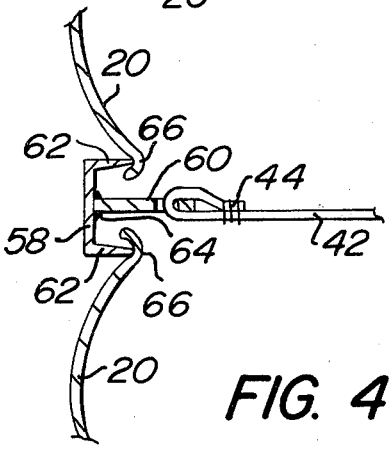
FIG. 4
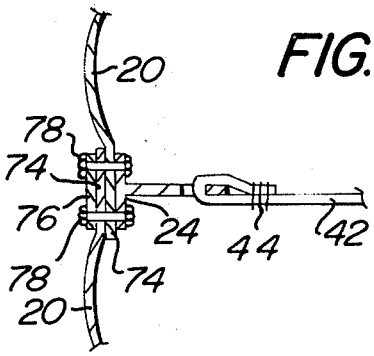
FIG. 6
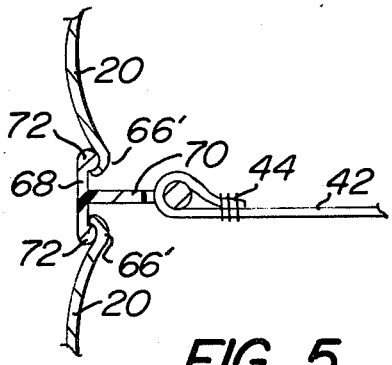
FIG. 5
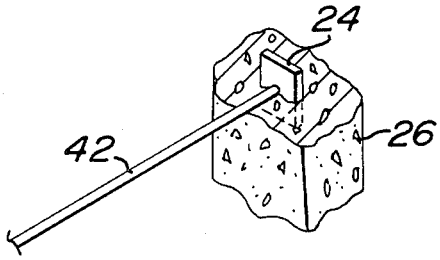
FIG. 7

FIG. 8
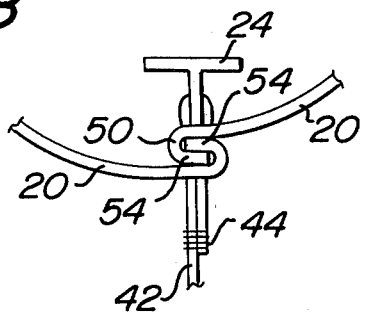
FIG. 9
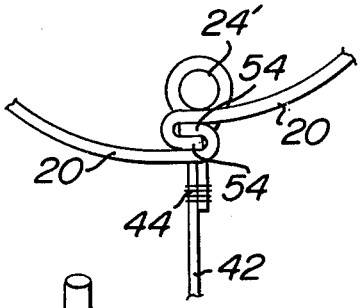
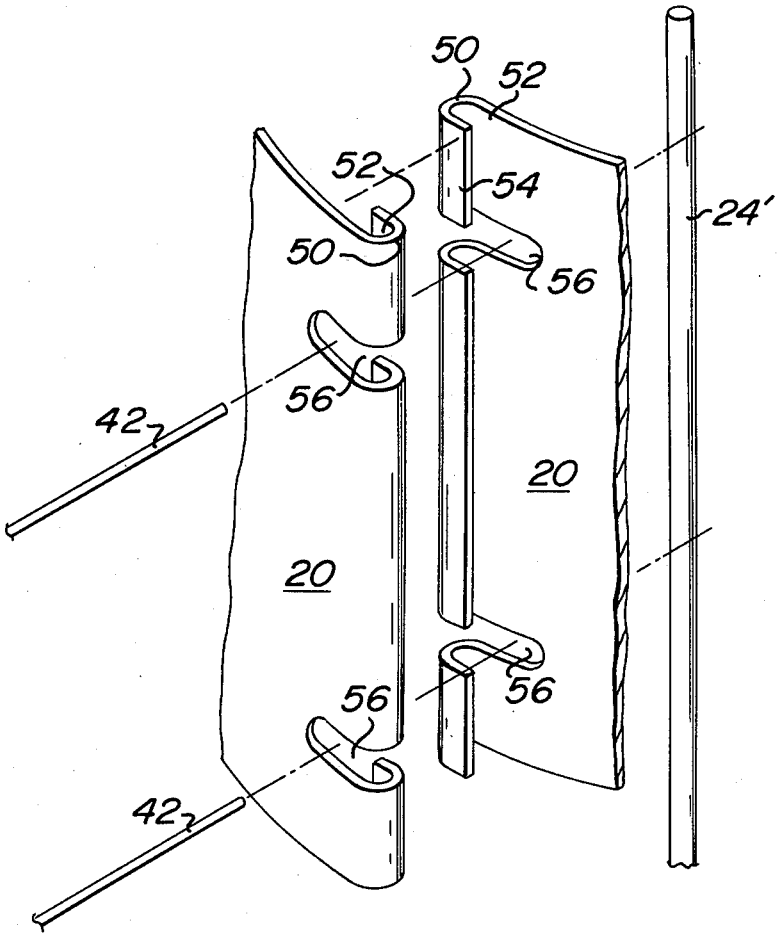
FIG. 10

REPLACEABLE BLADE ARROWHEAD

BACKGROUND OF THE INVENTION

This invention relates to an arrowhead having interchangeably replaceable blades of the type useful for hunters who prefer to use a bow and arrow.

An arrowhead of this general type is disclosed in U.S. Pat. No. 4,146,226 in which the blades fit into axial slots and are held in place by an inwardly projecting portion having a dovetail engagement with an axially adjustable element. In U.S. Pat. No. 4,169,597 the blades have a forward lip which fits under a removable cap, while a snap ring engages a rear portion of the blades to hold them in place. Other variations of arrowheads having removable blades are disclosed in U.S. Pat. Nos. 2,880,000; 2,912,247 and 3,995,860, while U.S. Pat. No. 2,820,637 discloses one in which two blades are welded together to form a single unit which slided on to the front of the shaft.

All of the blades shown in the foregoing patents are generally triangular in outline, with a single sharpened edge leading outwardly and rearwardly from a central tip.

BRIEF SUMMARY OF THE INVENTION

In the arrowhead of this invention, two or more flexible blades may be employed, each of the blades including a generally L-shaped strip of metal which; when the leading and trailing edges of both arms of the structure are sharpend, constitute two knives, one of which follows the other as the arrowhead passes through the hide of an animal to increase penetration.

The free ends of the L-shaped blade fit into slots in a tubular body and a rearwardly extending locking lip on each of these extremities holds the blade in place when the removable cap is screwed in place at the front end of the hollow body.

At least the forward one of the knives may be provided with a series of dull notches which entrap the hair of the animal to draw it into the wound to prevent the wound from closing.

The leading end of the cap may have a rounded, or dull leading surface to permit the arrowhead to be deflected away from a bone instead of penetrating the bone and having its travel into the tissue limited; and the flexibility of the blades is such that even when as many as four blades are used they will flex a sufficient amount to enable the arrowhead to pass between a pair of adjacent rib bones.

BRIEF DESCRIPTION OF THE DRAWINGS

FIG. 1 is a side elevation of a preferred form of arrowhead having two blades constructed in accordance with this invention;

FIG. 2 is a cross-sectional view of the arrowhead of FIG. 1 on a slightly larger scale;

FIG. 3 is a exploded perspective view of the arrowhead of FIGS. 1 and 2;

FIG. 4 is a cross-section of line 4—4 of FIG. 2;

FIG. 5 is a perspective view of an arrowhead similar in all respects to that of FIG. 1, but having four blades, and;

FIGS. 6–10 are diagrammatic representations of the performance of the arrowhead of this invention as it penetrates the hide of an animal.

DESCRIPTION OF A PREFERRED EMBODIMENT

In FIGS. 1–4, there is shown a portion of the front end of a conventional arrow shaft 15, which may be of metal, wood, fiberglass or other suitable material, to which is attached a two blades arrowhead, indicated generally by numeral 16, cnstructed in accordance with a preferred embodiment of this invention.

The arrowhead may be detachable secured to the shaft by means of a coupling element 17, provided at its lower end with a threaded shank 18 which fits into a suitably prepared socket at the front end of shaft 15. The upper end of the coupling is generally cut shaped with an internal upwardly projecting stub-shaft and the internal wall thereof may be threaded to detachably receive the externally threaded lower end 19 of a tubular body 20. The forward end of the tubular body is closed by a generally conical cap 21 which detachably secured in place by means of depending threaded boss 22.

In this connection it should be noted that, contrary to usual practice, the apex 23 of the conical cap does not terminate in a sharp point but presents a blunt surface, which is curvilinear in axial cross section for a purpose which will be explained later.

In the arrowhead of FIGS. 1–4, a pair of substantially identical blades, indicated generally by numeral 24, are detachably secured to the tubular body 20. Preferably these blades may be stamped from a thin flexible cutlery steel such as that used for razor blades, to provide a generally L-shaped structure comprising a forward knife 25 and a rearward knife 26. The forward edges **25*a* and 26*a* of both knife sections are preferably sharpened, while the respective rear edges 25*b* and 26*b* may also be sharpened for the purpose of facilitating removal of an embedded arrow. In addition, a series of hair-entrapping notches 27 whose inner surfaces are not sharpened, may be provided in the forward knife 25**.

The knives 25 and 26 are quite narrow in relation to their length, which not only reduces frictional resistance to passage through animal tissue but increases thin ability to pass around obstructions, such as bone, and also provides a large open area, indicated by numeral 28, tending to induce axial rotation of the shaft which improves flight trajectory.

The blades 24 are interchangeable and detachably secured to the tubular body 20 by virtue of the fact that the free ends 29 and 30 of the knives 25 and 26 are received within the respective axial slots 31 and 32 provided in body 20. To attach a blade, it is held in a downwardly tilted position so that the lower locking lip **30*a* can first be inserted into slot 32, after which the blade is tilted upwardly to introduce the remainder of the terminal portion 30 into the slot, bringing the upper terminal portion 29 in toward slot 31. By this maneuver slot 32 may be made only so long as to accommodate the width of the knife portion 39 just behind lip 30*a* and in this way when the blade is in place there is no chance that the end portion 30 can slide out of the slot 32 if a forwardly acting force is applied to it, as when the arrowhead is pulled out of a target. To complete attachment of the blade the coupling 17 is screwed upwardly to lock the lower ends of the blades in place and the cap 22 must be first removed or at least unscrewed a sufficient amount to clear the upper edge of terminal portion 29 as it is pushed into slot 31. To allow this slot 31** must obviously be long enough to accommodate locking lip 29*a* as it passes through. Since the dimensions of blade 24 are such that both locking lips 29*a* and 30*a* will be inwardly seated below their respective entry slots when installed, it may be necessary to slightly distort the blade when the end 29 passes through slot 31. After insertion, cap 22 is screwed down to the point where the lower face of boss 22 rests in abutment with the top edge of knife portion 29, as seen in FIG. 2. To remove a damaged blade, the cap is unscrewed and the blades will then easily pull out.

While only two blades have been used in the arrowhead just described, additional blades can be added, if desired, and FIG. 5 shows an arrangement in which two additional blades 33 are identical to blades 24 and additional supporting slots 31 and 32 are provided in the tubular body to accept them.

The initial impact of the arrowhead upon the hide of an animal is illustrated in FIG. 6 where it can be seen that the blunt leading surface 23, of cap 22, instead of immediately penetrating the surface of the hide 34 causes a crater-like depression surrounded by a conical area 35 which causes contact of the hide with almost the entire lengths of the sharpened leading edges 25*a* of the knives simultaneously. This results in the immediate creation of a larger wound and, furthermore, the provision of the blunt cap surface 23 means that if the arrow is headed toward a bone the cap will be deflected to pass around the bone instead of becoming embedded in it.

FIGS. 7 and 8 illustrate further action of the knife sections 25 and 26 as they pass through the tissue 36, after being deflected by a bone 37. In FIG. 7, the front knife 25 has penetrated far enough so that the rear knife 26 is about to enter. However, because the leading edge 26*a* of the rear knife is sharpened, it does not impede further progress when it comes into contact with the hide 34, and the front knife 25 moves deeply into the tissue as shown in FIG. 8.

FIG. 9 illustrates the fact when the hair-entrapping notches 27 of the front blade reach the hairs 38 they are combed inwardly into the wound because the inner surfaces of the notches are smooth and do not sever the hairs as they pass through. The presence of the hairs prevents the wound from closing after passage of the knife itself and increases bleeding.

FIG. 10 illustrates how the flexibility of the blades allows the arrowhead to pass between two ribs 39, even when the four-bladed modification of FIG. 5 is used.

Other modifications and improvements will be apparent to those skilled in the art which would come within the scope of the annexed claims.

I claim:

1. Arrowhead having generally L-shaped individually detachable blades, comprising:

a tubular body adapted to be secured at one end to the end of an arrow shaft;

said body being provided with circumferentially arranged pairs of axially spaced axially extending slots, each of said pairs of slots receiving therein the respective free ends of one of said L-shaped blades;

and securing means including a member axially movable on said body in one direction to positively lock each of the free ends of all of said blades against axial movement in either direction in said slots and against removal from said slots in a radial direction said axially movable member permitting removal of said blades when moved in the opposite direction.

2. Arrowhead as defined in claim 1, wherein said securing means includes means provided on one of the free ends of said blades for positively locking said one free end in place in one of said pairs of slots only when the respective other end of the free ends has been inserted into the respective other end of the pairs of slots.

3. Arrowhead as defined in claim 2, wherein said one free end of a blade is provided with a laterally projecting lip to engage with the inner surface of the tubular body adjacent one end of said one of said pairs of slots, the length of said one slot being equal only to the width of said one free end just behind said lip, whereby said one free end may be inserted into said one slot only by tilting the blade to initially insert said lip.

4. Arrowhead as defined in claim 3, wherein the other free end of a blade is provided with a laterally projecting lip to engage with the inner surface of the tubular body adjacent to one end of the other of said pairs of slots, the length of said other slot being sufficient to admit said other free end in a radial direction without the necessity of a tilting motion.

5. Arrowhead as defined in claim 4, wherein said axially movable member is threadedly mounted on said body for axial abutment with said other free end of each blade to lock the other free ends in place.

6. Arrowhead as defined in claim 5 wherein said axially moveable member comprises a cap mounted on the leading end of said body for abutment with said other free ends when rearwardly displaced.

7. Arrowhead as defined in any one of claims 1, 2, 3, 4, 5 or 6, wherein the arms of said L-shaped blades comprise forward and rearward knife means, the leading edge of the forward knife means being provided with a plurality of unsharpened hair-entrapping notches.

8. Arrowhead as defined in any one of claims 1, 2, 3, 4, 5 or 6, wherein the leading edge of said rearward knife means is sharpened.

9. Arrowhead as defined in claim 6, wherein the leading end of said tubular body is internally threaded, and said cap is provided with a threaded boss to be operatively received in said threaded portion for abutment with said other free ends.

10. Arrowhead as defined in claim 6 wherein the greatest diameter of said cap does not exceed the transverse cross-section of the tubular body.

11. Arrowhead as defined in claim 6 wherein the leading surface of said cap is arcuate in axial cross-section.

* * * * *